United States Patent [19]

Godley, Sr.

[11] 4,312,461

[45] Jan. 26, 1982

[54] NEWSPAPER VENDING MACHINE

[76] Inventor: Fred O. Godley, Sr., 611 Oakdale Rd., Charlotte, N.C. 28216

[21] Appl. No.: 162,938

[22] Filed: Jun. 25, 1980

[51] Int. Cl.[3] ..... G07F 11/48

[52] U.S. Cl. ..... 221/195; 221/190; 221/279; 194/2

[58] Field of Search ..... 221/186, 190, 191, 192, 221/194, 195, 279; 194/2

[56] References Cited

U.S. PATENT DOCUMENTS

| | | | |
|---|---|---|---|
| 2,491,615 | 12/1949 | Laird | 221/195 X |
| 3,104,781 | 9/1963 | Clift | 221/195 X |
| 3,705,665 | 12/1972 | Gunzler | 221/279 X |
| 3,905,530 | 9/1975 | Emmel | 221/279 X |

FOREIGN PATENT DOCUMENTS

| | | | |
|---|---|---|---|
| 1208309 | 10/1970 | United Kingdom | 221/195 |

*Primary Examiner*—Joseph J. Rolla
*Attorney, Agent, or Firm*—Clifton T. Hunt

[57] ABSTRACT

A machine for vending single copies of newspapers comprises a magazine compartment housing a downwardly and forwardly inclined newspaper support platform, a driving arrangement for lowering the platform to the base of the machine preparatory to loading newspapers on the platform, a manually operable crank mechanism responsive to insertion of a coin to permit rotation of the crank mechanism to raise the platform a distance determined by the thickness of the single paper, a dispensing wedge and a discharge chute horizontally aligned with each other, whereby a single copy newspaper is dispensed across the dispensing wedge and through the discharge chute as the newspaper support platform is elevated said predetermined distance by the manually operable crank mechanism in response to a coin being inserted in the machine.

9 Claims, 12 Drawing Figures

FIG. 5A
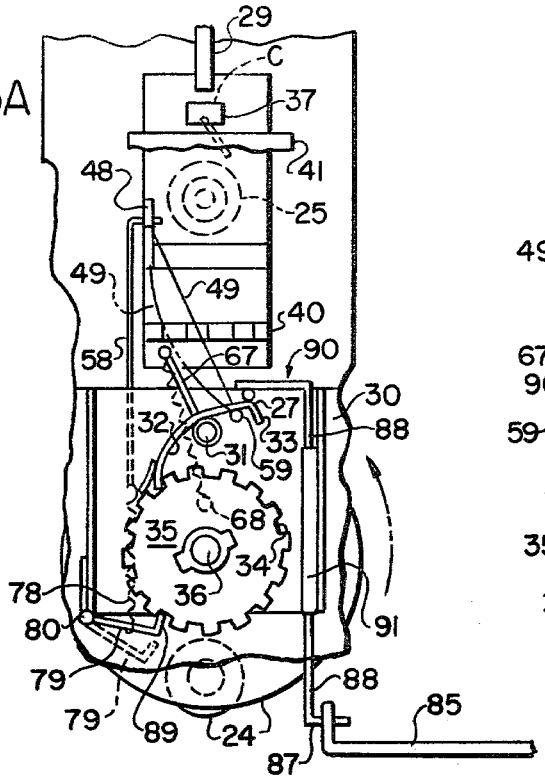
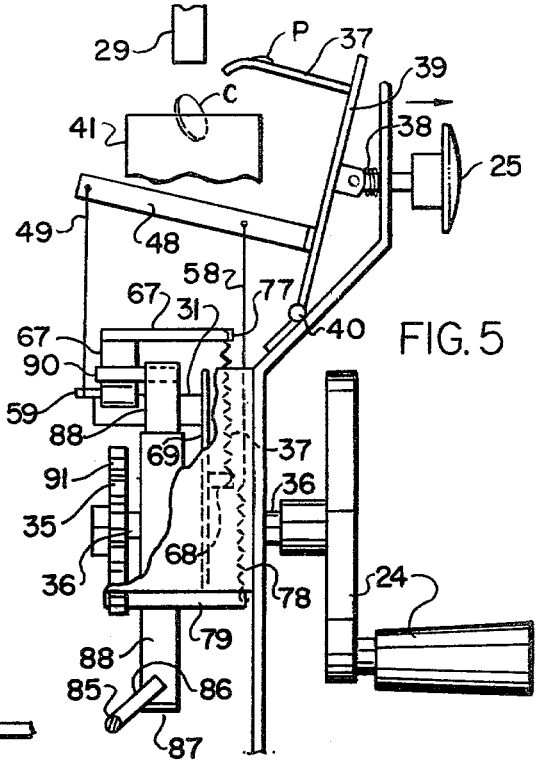
FIG. 5
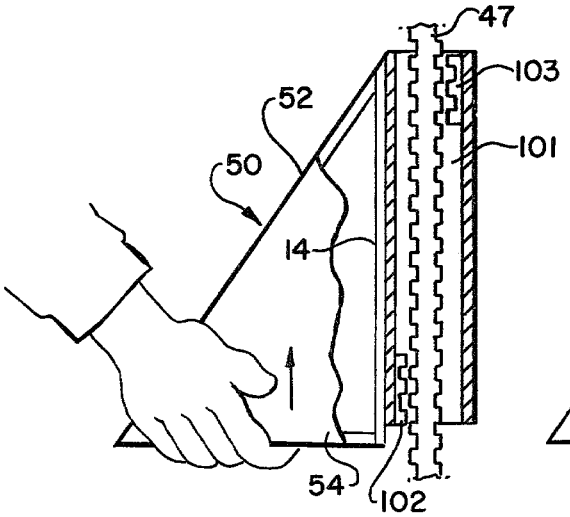
FIG. 8
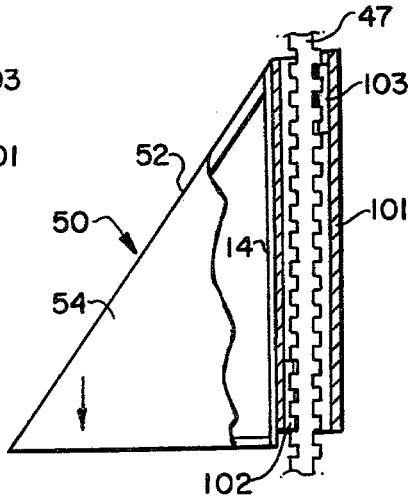
FIG. 8A

NEWSPAPER VENDING MACHINE

BACKGROUND OF THE INVENTION

Most newspapers vending machines on the market today are coin actuated and the insertion of a coin in the machine enables the prospective purchaser to open a door to gain access to the entire supply of newspapers within the machine. This type of vending machine has proven unsatisfactory because it places the entire supply of newspapers at the mercy of the purchaser, who sometimes removes more than the single copy of newspaper to which the deposit of coins entitles him.

Prior attempts have been made to overcome this problem by designing vending machines to dispense only a single copy of the newspaper in response to the insertion of coins in the machine. The scarcity of single copy newspaper vending machines in commercial use today is stark evidence of the failure of the prior art designs for single copy newspaper vending machines to satisfy the market needs.

One prior attempt to satisfactory dispense individual copies of newspaper is disclosed in U.S. Pat. No. 3,912,124 issued Oct. 14, 1975 to Dale F. Pinkerton. Pinkerton uses an upwardly and rearwardly inclined newspaper support platform on which the papers are placed in upright position with their folded ends resting on the platform. Insertion of a coin enables the perspective purchaser to rotate a crank which moves the platform rearwardly and allows the foremost newspaper to drop through the space created between the rearwardly moved platform and the front of the machine, from whence it is discharged through a dispensing outlet. The practical difficulty with the Pinkerton vending machine is that the dispensing of the newspaper depends on gravity movement of the newspaper along the inclined platform and it sometimes happens that the newspapers are misaligned on the platform to the extent they become jammed and do not slide freely down the inclined platform.

Other attempts to provide a satisfactory machine for dispensing individual copies of newspapers are discussed in columns 1 and 2 of the said Pinkerton patent, specifically U.S. Pat. Nos. 953,451 to P. Wesser, 1,057,971 to J. J. Marrs, 1,324,415 to F. Smith, 1,600,623 to Chesnut, et al., 1,702,925 to M. E. Ashe, 1,882,261 to J. G. Schofield, 2,220,175 to W. C. Rice, 2,263,040 to E. M. Kaltenbach, 2,510,197 to R. H. Summerfield, 2,168,422 to L. S. Watlington, 3,104,781 to E. E. Clift, and 3,425,596 to T. S. Marczak, et al. Applicant is also aware of U.S. Pat. Nos. 388,369 to G. D. Morse, et al. and 517,412 to A. F. Martel for dispensing individual copies of newspapers and of U.S. Pat. Nos. 1,865,895, 2,281,191, and 2,550,884 for dispensing other articles.

It will be apparent as the description of the present invention proceeds that it offers a novel mechanism for the individual vending of newspapers and at the same time provides for the trouble free and reliable vending of single copies of newspapers to an extent not heretofore known.

SUMMARY OF THE INVENTION

According to the present invention, single copies of newspaper of any thickness may be reliably discussed in response to the insertion of a coin in the machine and the manual manipulation of a crank mechanism to elevate a newspaper support platform. The newspapers are stacked on the platform with their folded edges facing the front of the machine and with a flat surface lying on the platform. The folded edges rests against the vertically extending base of a dispensing wedge over which successive newspapers pass as the platform is elevated in response to insertion of successive coins in the machine and the successive rotation of the crank mechanism to elevate the platform. The dispensing wedge is located in horizontal alignment with a dispensing slot in the front of the machine through which successive newspapers pass to successive purchasers. Each successive newspaper decreases a locking latch as it passes through the dispensing slot and the locking latch functions to deactivate the dispensing machine until another coin is inserted in the machine which releases the locking mechanism so the crank can be manually rotated to raise the support platform only sufficiently to release another paper.

An important feature of the invention is the capability of quickly lowering the platform to the base of the machine preparatory to being loaded with newspapers. This feature enables the machine to be quickly loaded which is an advantage over several vending machines in the prior art which utilize a separate shelf for each newspaper thus requiring an inordinate amount of time to individually load newspapers on successive shelves.

Still another object of the present invention is to provide an inclined platform on which the newspapers are stacked with one flat side down and the folded edges of the newspapers bearing against the vertically rising base of a dispensing wedge so that the danger of the newspaper becoming misaligned or jammed on the support platform is minimized to a much greater extent than if the newspapers were supported with their folded edges resting on the support platform as in the prior art.

BRIEF DESCRIPTION OF THE DRAWINGS

FIGS. 5 and 5A are views similar to FIGS. 4 and 4A, respectively, and sequentially illustrate the movement and relationship of parts after the deposit of coins and extension of the knob preparatory to dispensing a paper;

FIGS. 8 and 8A are vertical sectional views illustrating a modified form of the release mechanism.

DETAILED DESCRIPTION OF THE INVENTION

Figure 1:
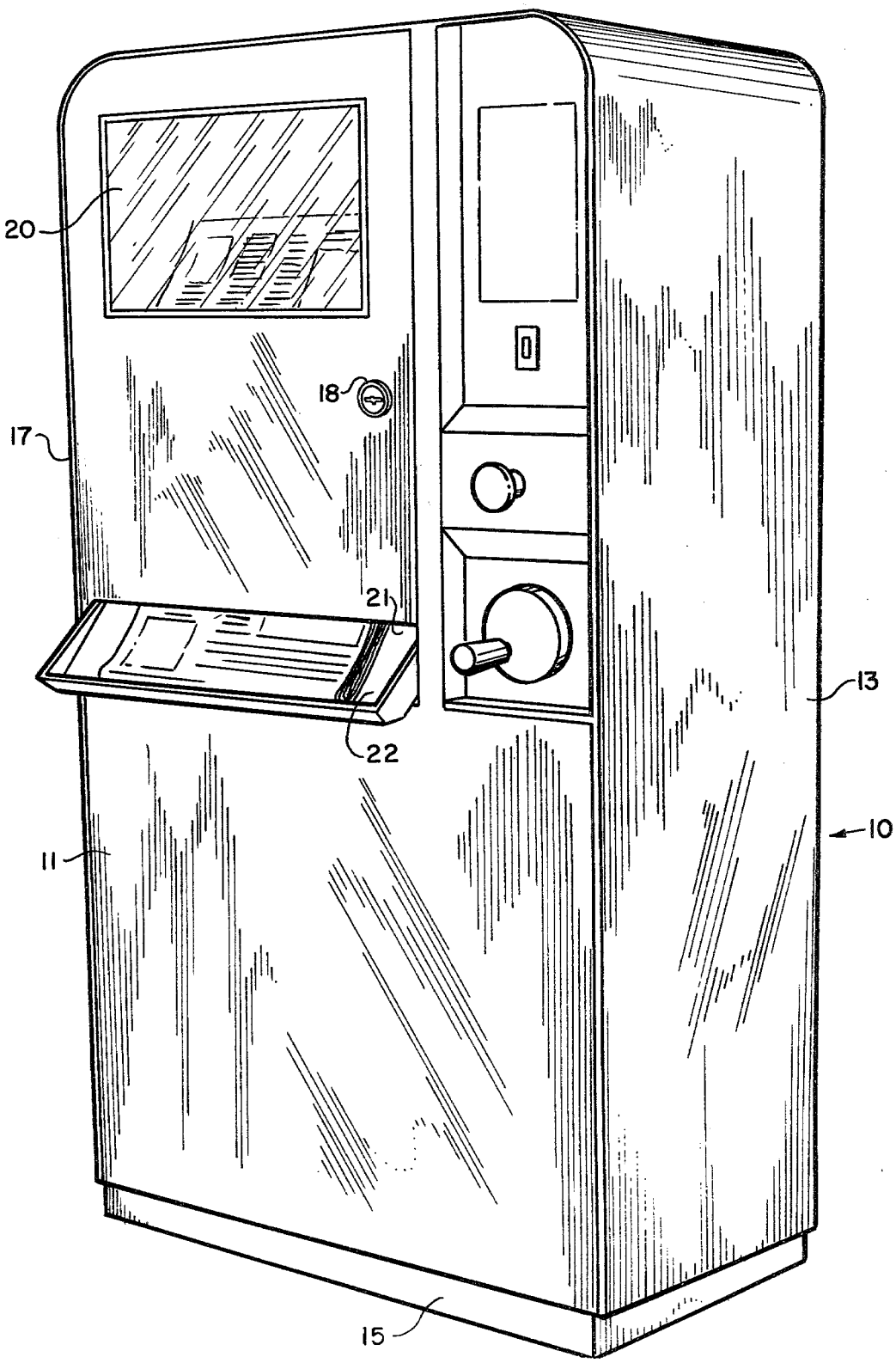
FIG. 1 is a perspective view looking at the front and one side of the single copy newspaper vending machine.

Referring more specifically to the drawings, the numeral 10 generally indicates a single copy newspaper vending machine. The dimensions of the machine are not critical except as to the number of newspapers which may be placed in the machine for distribution. The newspapers are distributed sequentially from a vertically arranged stack of newspapers so that the taller the machine the more newspapers can be placed in it for eventual distribution to successive customers.

In the preferred embodiment of the invention the machine comprises a cabinet or housing four feet tall and including a front wall 11, side wall 12 and 13, rear wall 14, a bottom wall or base 15 and a top wall 6. An access door 17 is provided in the upper part of the front wall 11 and includes a key-actuated lock 18 to normally prevent access to the interior of the machine by the public but by means of which the proprietor of the machine can open the door 17 to load newspapers in the machine for sale to the public. The door 17 also includes a glass covered window 20 through which the public can see the supply of newspapers N in the machine before depositing coins to buy a paper. A dispensing chute 21 and a holding tray 22 are formed in the lower portion of the door 17. Successive papers pass through the chute 21 and come to rest in the tray 22 in response to the feeding of successive coins into coin slot 23, the successive extension and release of a control knob 25, and the successive rotation of a manually operable crank 24 to dispense successive newspapers.

The vending machine of the present invention assures that only a single copy of a newspaper will be reliably dispensed through a chute 21 and into the tray 22 each time an appropriate coin or coins C are inserted in coin slots 23 and the control knob 25 and crank 24 are manipulated in accordance with instructions printed on the machine.

The dispensing mechanism of the present invention includes a conventional coin activated release mechanism 19 including a coin chute 29 communicatively connected to the coin slots 23 and extending to a release plate 37 operatively connected in a conventional manner to the control knob 25 projecting through the front wall 11. The knob 25 is normally urged inwardly against the outer surface of the front wall by a spring 38 surrounding a shaft 25A extending inwardly of front wall 11 from knob 25. The inner end of shaft 25A is fixed to a pivotal plat 39 journaled on a pivot pin 40.

A coin box 41 is positioned beneath the coin chute 29 and receives coins after they depress a suitably pivoted portion P of release plate 37 to activate knob 25. The coins C fall into the coin box 41 after the knob 25 is manually pulled forward, in accordance with the printed instructions, to pivot the plate 39 and its rearwardly extending release plate 37 forwardly and to the right in FIG. 5, moving the release plate 37 from beneath the coint chute 29 and permitting the coins to fall into the coin box 41.

A prospective purchaser is informed by instructions on the front of the cabinet to (1) insert appropriate coins in the coin slot 23, (2) pull the knob 25 outwardly, (3) release the knob, and (4) rotate the crank 24 to dispense a newspaper. The knob 25 and crank 24 are normally inoperative, but the knob 25 becomes operable in a conventional manner upon the deposit of proper coins on the release plate 37. A lift arm 48 extends rearwardly in cantilever fashion from pivotal plate 39 and has links 49 and 58 depending downwardly therefrom. Link 49 is flexible and its lower end is connected to a stub shaft 59 fixed to and projecting rearwardly from beneath the locking end 27 of a lever 28 pivotally mounted adjacent its mid-point to a supporting frame 30 as at 31. The locking end 27 of lever 28 includes a downwardly turned lug 33 engageable with any one of a plurality of slots 34 spaced around the periphery of a locking disc 35. The locking disc 35 is fixed on a shaft 36 journaled in supporting frame 30.

Figure 4A:
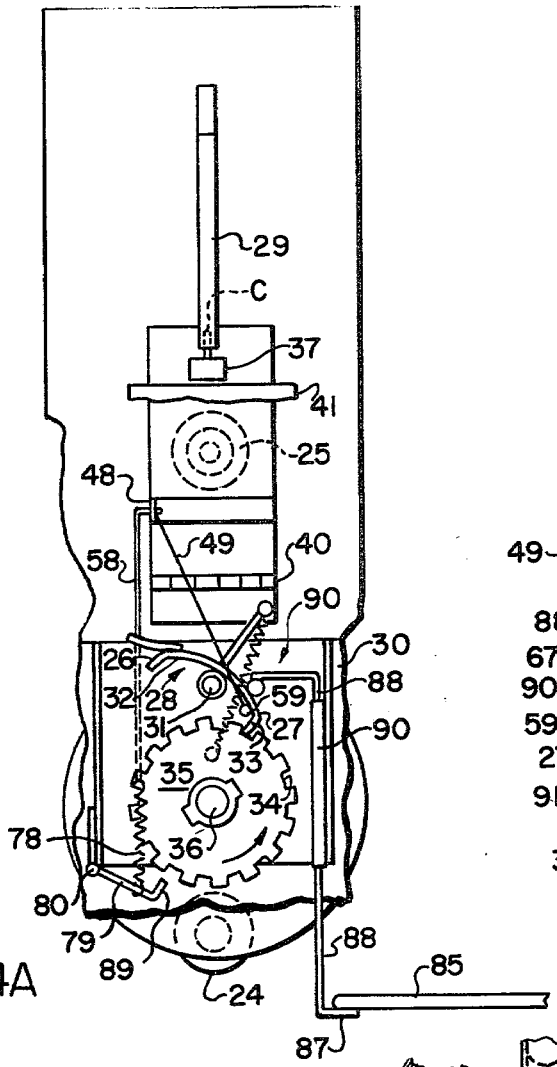
FIG. 4A is a rear view of the drive mechanism for elevating the support platform, and looking at the left side of FIG. 4.
Figure 4:
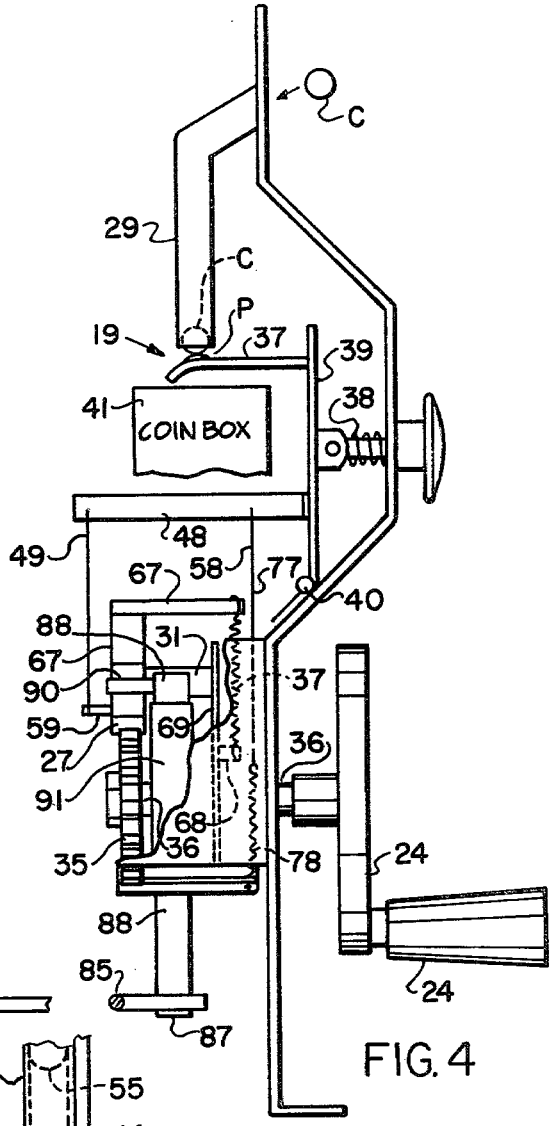
FIG. 4 is a vertical sectional view taken substantially along the line 4—4 in FIG. 2.
Figure 6A:
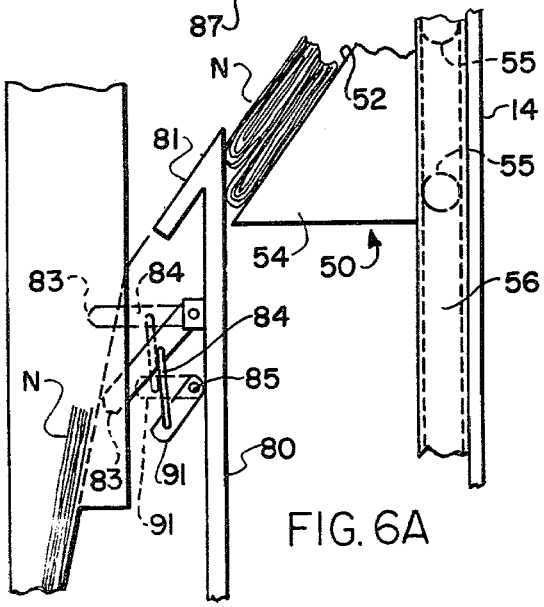
FIG. 6A is a fragmentary side elevation view similar to FIG. 6 but showing the locking lever engaged and actuated by a dispensed newspaper.

The lever 28 includes a balance arm 32 extending in the opposite direction from the locking end 27 at the mid-point of the lever 28 (FIGS. 4A and 5A). The lever 28 is of generally arcuate configuration, as seen in FIGS. 4A and 5A, with the outer free end 26 of the balance arm 32 and the lug 33 of the locking end 27 extending downwardly toward locking disc 35 in FIGS. 4A and 5A. An L-shaped bracket 67 rises from the midpoint of lever 28 and extends forwardly toward the front wall 11 of the cabinet. A spring 37 extends between the forward or free end 77 of the L-shaped bracket 67 and a stub shaft 68 extending forwardly from a vertically extending fixed position 69 supported between the disc 35 and front wall 11 (FIGS. 4 and 5). The spring 37 normally biases the lever 28 to the right in FIG. 4A urging the lug 33 into one of the slots 34 spaced around the periphery of the locking disc 35. In this position, the machine is inoperative and will not dispense a newspaper until the lug 33 is raised out of engagement with the disc 35.

When the knob 25 is pulled forwardly after deposit of the coins C, the pivotal plate 39 is pivoted forwardly relative to the pin 40 from the vertical inoperative position illustrated in FIGS. 4 and 4A to the forwardly inclined operative position shown in FIGS. 5 and 5A. As best seen in FIGS. 5 and 5A, pivotal movement of plate 39 toward front wall 11 elevates left arm 48 and flexible link 49, overcoming spring 37 and pivoting lever 28 to the left in FIG. 5A to lift lug 33 out of engagement with disc 35 and lowering free end 26 of balance arm 32 into nonbinding or ratcheting engagement with disc 35.

At the same time the forward pivotal movement of the plate 39 and the consequent elevation of the lift arm 48 raises the link 58. Link 58 preferably has a spring 78 connected to its lower end and extending downwardly therefrom to its connection with a latch 79 pivoted as at 80 to the frame 30 adjacent locking disc 35. The latch 79 inclues a lug 89 extending toward the disc 35, and the upward movement of lift arm 48 in response to outward movement of knob 25 moves latch 79 to the solid line postion shown in FIG. 5A with a lug 89 seated within a notch 34 in locking engagement with disc 35 simultaneously with lug 33 on lever 28 being lifted out of locking engagement with disc 35. This is a security provision to prevent the disc 35 from being rotated by manipulation of the crank 24 while the extended knob 25 holds the locking lug 33 away from the disc 35. Otherwise, an unscrupulous person could continue rotating crank 24 and disc 35, until knob 25 extended, until all of the newspapers were dispensed.

The lug 89 remains in locking engagement with the disc 35 only as long as the knob 25 is extended to pivot the plate 39 and elevate the linkage 58, 78 to hold the latch 79 in the solid line position shown in FIG. 5A.

When the knob 25 is released, in accordance with the instructions the plate 39 returns to its normal vertical position which removes the tension from the linkage 58, 78 and causes the latch 79 to move by gravity out of locking engagement with disc 35 and to the dotted line position shown in FIG. 5A.

When the knob 25 is released and the plate 39 and lift are 48 return to their respective vertical and horizontal positions as shown in FIG. 4, the lever 28 and its lug 33 remain in the non-functional position of FIG. 5A with the lug 33 away from the disc 35. This is so because the upper end of spring 37 which normally urges lug 33 into locking engagement with disc 35 has been moved by the L-shaped bracket 67 from a first locking position on one side of the axis of disc 35 (FIG. 4A) to a second operating position on the other side of said axis (FIG. 5A). Thus, even though the flexible link 49 moves from the tensioned solid line position to the slackened dotted line position in FIG. 5A, the lug 33 remains out of locking engagement with the disc 35 because the spring 37 now urges the free end 26 of lever 28 into ratcheting engagement with disc 35, supporting the lever 28 in the position of FIG. 5A.

When the lever 28 was pivoted to the position of FIG. 5A by the extension of knob 25 and consequent elevation of lift arm 48, the tensioned linkage elevated the stub shaft 59 fixed to the lower surface of the locking end 27 of lever 28 to pivot the lever 28 from the locking position of FIGS. 4 and 4A to the operative position of FIGS. 5 and 5A, and carried with it a locking finger 90 resting on the upper surface of locking end 27 of lever 28 and fixed to a vertically reciprocable shaft 88 journalled in a housing 91. The locking finger 90 is operatively connected to a locking lever 83 which is repeatedly activated as successive newspapers N are dispensed to return lug 33 into locking engagement with disc 35 awaiting the deposit of additional coins to begin a new cycle.

Figure 2:
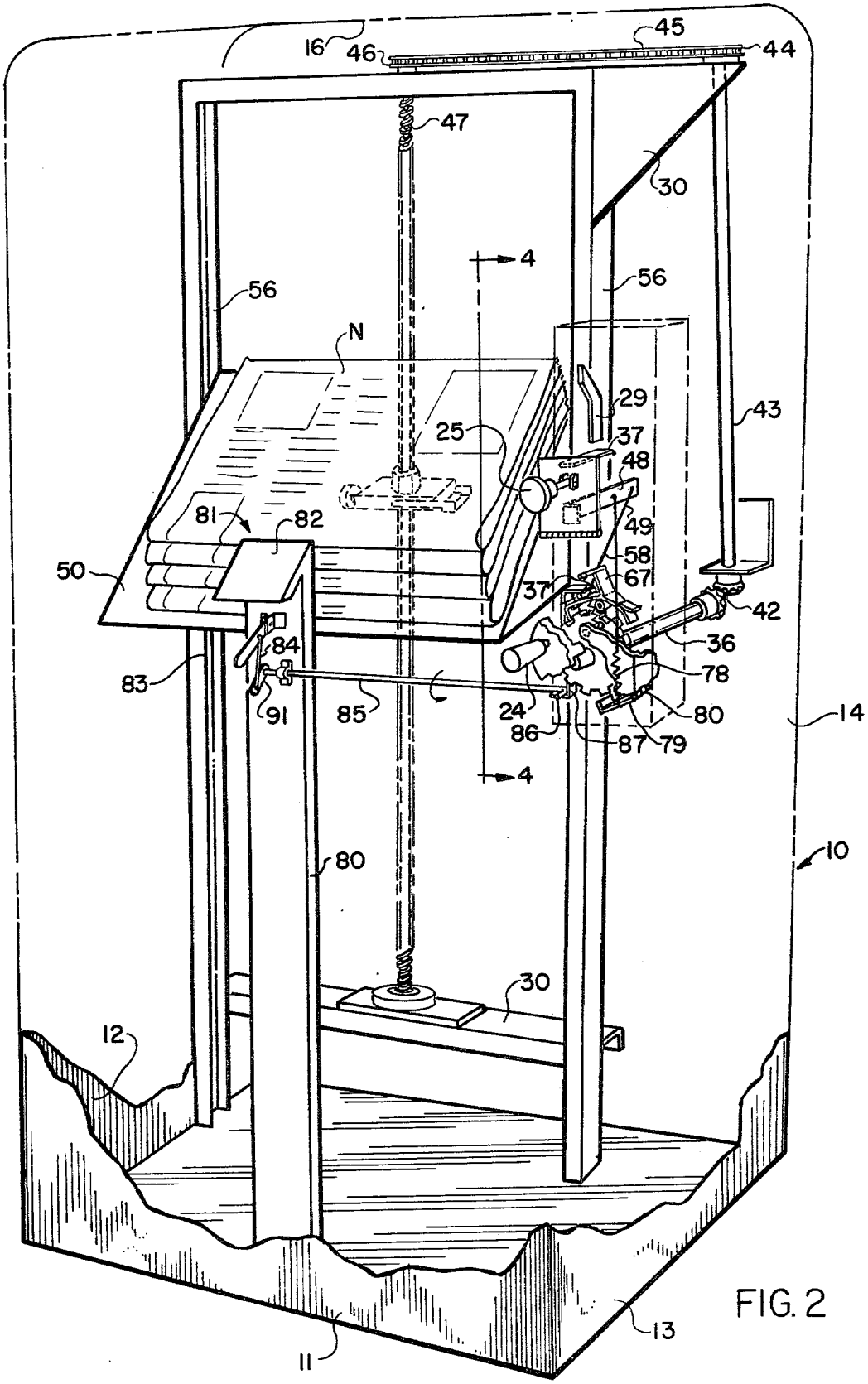
FIG. 2 is a view similar to FIG. 1 but with parts broken away and illustrating the drive mechanism for elevating the support platform.
Figure 3:
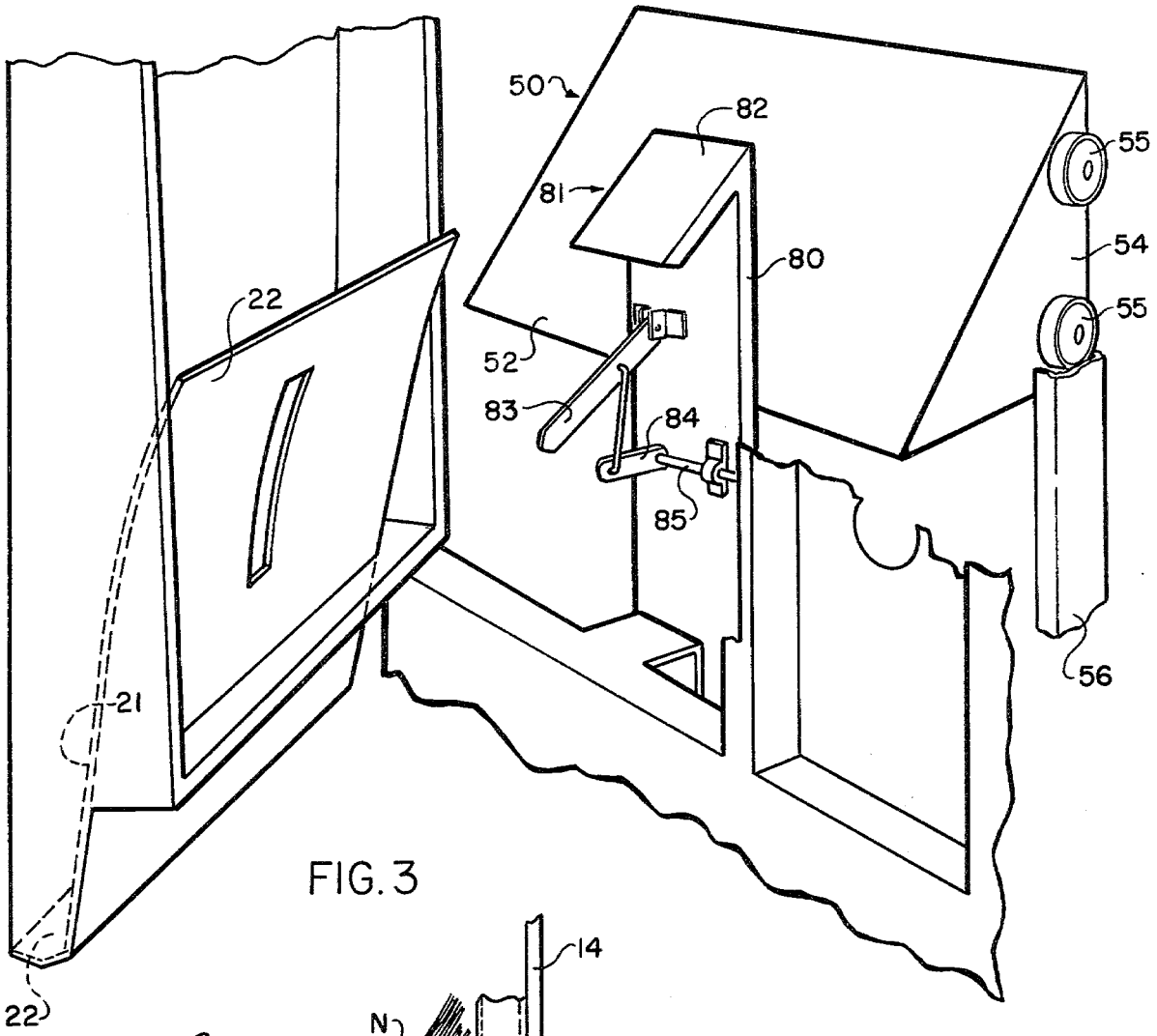
FIG. 3 is a perspective view similar to FIG. 1 but showing the access door open to permit newspapers to be loaded on the platform and illustrating the dispensing wedge and the trip lever for locking the elevating mechanism.

With the lever 28 and latch 79 in the position of FIG. 5A following the deposit of coins and the extension and release of knob 25, the crank 24 should now be manipulated by the customer, in accordance with the instructions, to rotate shaft 36 and disc 35 fixed thereto in a clockwise direction in FIG. 2 (Counterclockwise in FIGS. 4A and 5A).

Rotation of shaft 36 imparts corresponding rotation to bevel gears 42 and a shaft 43 extending vertically and in right angular relation to shaft 36 to impart corresponding rotation to sprocket gear 44 journaled on support frame 30 at the top of the inner surface of the rear wall 14. A sprocket chain 45 extends between gear 44 and a second sprocket gear 46 fixed to the upper end of a threaded rod or drive shaft 47 journaled at its upper and lower ends to support frame 30 at the top and bottom of rear wall 14.

Figure 6:
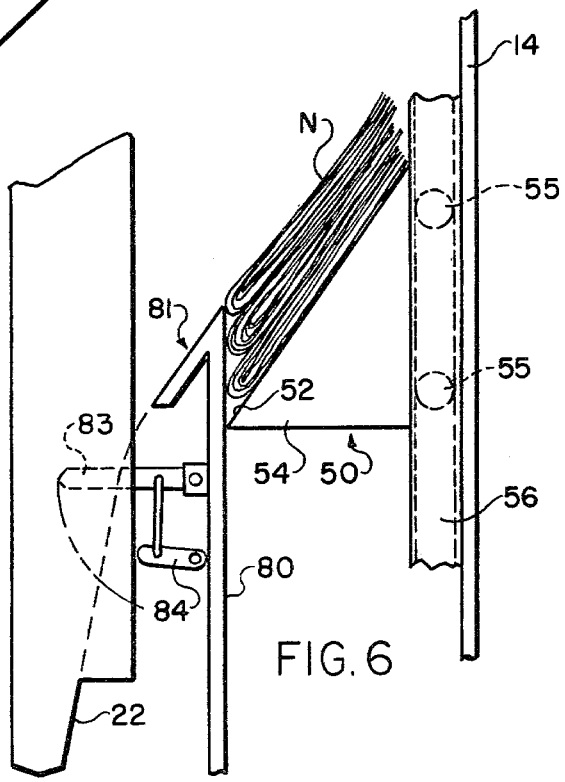
FIG. 6 is a fragmentary side elevation looking at the right side of FIG. 3 and illustrating the path followed by successive newspapers while being dispensed.

A newspaper support platform broadly indicated at 50 is operatively connected to the threaded drive shaft 47 by a split-nut connecting assembly broadly indicated at 51 (FIG. 6). The platform 50 is of triangular configuration in cross section and includes an upwardly and rearwardly inclined front wall 52, a rear wall 53 which normally extends in a vertical plane, and a side wall 54. A pair of vertically spaced rolls 55 are journaled in each side wall 54, the rolls 55 being mounted for reciprocatory vertical movement in vertically extending tracks 56 on each side of the platform 50.

The split-nut connecting assembly 51 is mounted to the rear surface of the vertical rear wall 53 of platform 50 as by bolts which penetrate the rear wall 53 and the proximal wall of a housing 57 of the split-nut connecting assembly 51. The assembly 51 comprises an interiorally threaded nut diametrically cut in half to define split-nut portions 60 and 60'. With the split-nut portions 60, 60' arranged with their threaded surfaces facing each other as shown in FIG. 6, plates 61, 61' are welded or otherwise fixed to pposed distal flat surfaces of respective split-nut portions 60, 60'. Pins 62, 62' extend in opposite directions from the distal surfaces 63 of respective plates 61, 61' and springs 64, 64' loosely surround respective pins 62, 62' and bear against respective end walls 65, 66, and plates 61, 61' to normally urge the split-nut portions 60, 60' together.

Arranged in this fashion, the interiorally threaded split-nut portions 60, 60' threadably engage the threaded drive shaft 47 so that rotation of the shaft 47 responsive to manipulation of the crank 24 will elevate the platform 50.

A pair of cams 70 are positioned between the plates 63, 63' on opposite sides of the split-nut portions 60, 60'. Each cam 70 is fixed to the free end of a stub shaft 71 and each stub shaft 71 is fixed to the inner end 72 of a yoke-like handle 73. A down turned hand-grip 74 completes the handle 73. Upward movement of the handle 73 causes the cams 70 to rotate to the left in FIG. 6 and bear against plates 61, 61' to overcome the springs 64 and move plate 61 away from plate 61' to separate the split-nut portions 60, 60' so that they no longer threadably engage the threaded drive shaft 47. With the handle 74 in its elevated position and with the split-nut portions 60, 61' removed from threadable engagement with shaft 47, the platform 50 may be moved freely relative to shaft 47 to quickly lower it in position to be loaded with newspapers.

The handle 73 is lowered to the horizontal position shown in FIG. 6 after the platform 50 has been fully lowered and at that time the cams 70 are returned to the position shown in FIG. 6 to permit the springs 64 to move the split-nut portions 60, 60' together into threadable engagement with shaft 47. Then, when crank 24 is rotated to impart rotation to shaft 47 the platform 50 moves upwardly on shaft 47 to dispense successive newspapers. A roller 75 is mounted on a stub shaft 76 fixed to the end wall of housing 57 to offset the torque occasioned by rotation of the shaft 47 relative to the split-nut connecting assembly 51.

Referring to FIG. 2, with the lug 33 moved out of its notch 34 in response to a coin being inserted in coin slot 23, the crank 24 may be manually operated to rotate locking disc 35, shaft 36 and drive shaft 47 to elevate platform 50 and move the stack of newspapers N in touching engagement with and along the vertical base 80 of a dispensing wedge broadly indicated at 81. The dispensing wedge 81 has an inclined plate 82 at the top of the vertical base 80, the plate 82 sloping downwardly and outwardly from its juncture with the base 80.

As the platform 50 is elevated relative to the base 80, the folded edges of newspapers N slide upwardly along the smooth inner surface of base 80. The stack of newspapers continues to rise relative to base 80 until the upper-most newspaper N is raised above the dispensing wedge 81, at which time it slides across the inclined face 82 and through the dispensing chute 21 into the holding tray 22. As the newspaper N passes into the chute 21 it engages a pivoted locking lever 83 connected by linkage 84 to a finger 91 fixed to a shaft 85 extending between the discharge chute 21 and a point adjacent the locking disc 35. A finger 86 projects radially outwardly from shaft 85 and bears against an angular end 87 of a vertically extending locking bar 88 having a locking finger 90 projecting from its other and in overlying relation to the locking end 27 of lever 28 (FIGS. 4A and 5A).

As a newspaper N engages the locking lever 83, rotation is imparted to the shaft 85 which moves finger 86 downwardly against the angular end 87 of shaft 88, moving locking finger 90 against the locking end 27 of lever 28 to move lug 33 into the proximal notch 34 as shaft 36 and locking disc 35 are rotated. It is thereafter impossible to rotate the handle 24 and shaft 36 until another coin is put in the coin slot 23 and the knob 25 is extended and released to pivot the lever 28 to the operative position of FIGS. 5 and 5A.

Referring to FIGS. 8 and 8A, a modified form of release mechanism whereby the platform 50 may be freely lowered relative to the threaded drive shaft 47 comprises a tubular sleeve 101 having an inside diameter greater than the outside diameter of the shaft 47. The sleeve 101 is fixed to the rear wall 14 of the platform 50 and one-half of a diametrically split-nut 102 is fixed to the inner surface at the lower end of that portion of the tubular sleeve 101 proximate to the platform 50. The other half 103 of the diametrically split-nut is fixed to the inner surface at the top of that portion of the tubular sleeve 101 remote from the platform 50.

Figure 7:
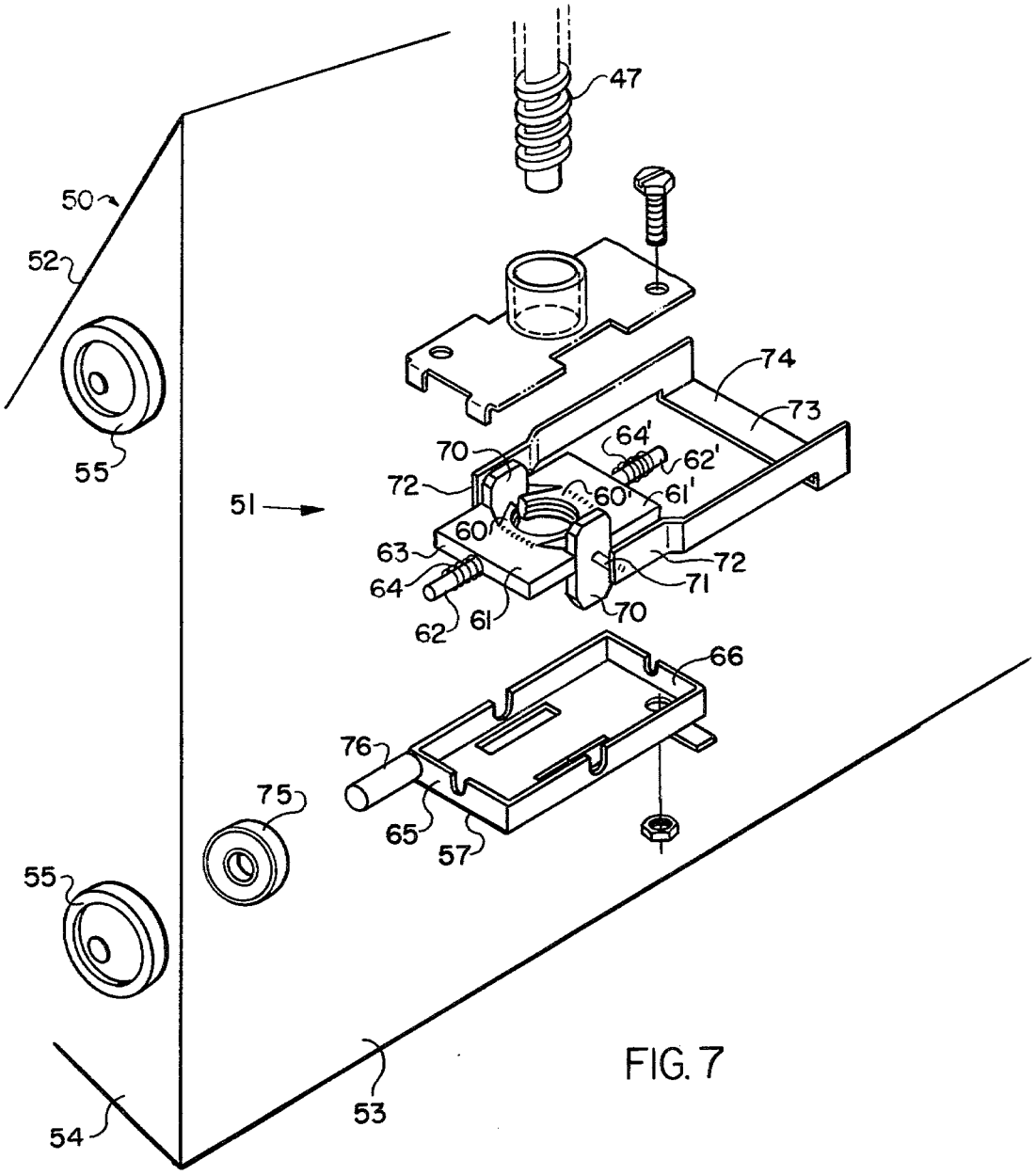
FIG. 7 is a vertical sectional view, partially in elevation, illustrating a release mechanism which enables the platform to override the threads on the drive shaft when it is desired to lower the platform to load it with newspapers.

The axes of the drive shaft 47 and the tube 101 may be aligned by lifting the platform 50 sufficiently to align the axes as illustrated in FIG. 7, but the weight of the platform pulls the split-nut 103 at the top of sleeve 101 into threadable engagement with the threaded drive shaft 47 and moves the split-nut 102 at the lower end of tube 101 into threadable engagement with the threaded shaft 47. In this position the platform 50 is threadably engage with rod 47 and may be elevated to dispense a newspaper as the shaft 47 is rotated by the crank 24. The platform 50 is initially raised sufficiently to align the axes of sleeve 101 and shaft 47 and remove the split-nuts 102, 103 from the shaft 47 to release the platform from shaft 47, after which the platform is manually lowered vertically to receive a fresh supply of newspapers.

There is thus provided an improved newspaper vending machine which utilizes a positive drive mechanism to positively and reliably sequentially dispense single copies of newspapers.

In the drawings and specification there has been set forth a preferred embodiment of the invention and although specific terms have been employed, they are used in a descriptive sence only and not for purposes of limitation.

I claim:

1. In a single copy newspaper vending machine having a cabinet within which a supply of newspapers is placed for sequential dispensing and having a dispensing mechanism activated by a coin operated release mechanism, said dispensing mechanism comprising a newspaper supply platform including an angularly disposed surface extending upwardly and rearwardly and on which the supply of newspapers is positioned with one flat side of the newspapers facing downwardly and the folded edge of the newspapers facing forwardly of the machine, a dispensing wedge including a vertical base mounted in said cabinet in front of the platform and engageable with the folded edges of the supply of newspapers, an upwardly and rearwardly inclined face on the top of the vertical base of said dispensing wedge, means to raise the platform, means responsive to insertion of a coin in the machine to activate said means to raise the platform and the newspapers thereon along the vertical base until the upper-most newspaper rises over the inclined face of the dispensing wedge, a dispensing chute aligned with the inclined face of the dispensing wedge to define a path of travel for the newspaper after it moves across the inclined face of the dispensing wedge, and means in the path of travel of a dispensed newspaper for locking said means to raise the platform.

2. A structure according to claim 1 wherein said means to raise the platform includes a vertically extending threaded drive shaft, means for operatively connecting the newspaper support platform to the drive shaft, and means for rotating the shaft to elevate the platform.

3. An apparatus according to claim 2 wherein said means for operatively connecting the newspaper support platform to the drive shaft includes release means for enabling the platform to become disengaged from the drive shaft and slide freely along the shaft.

4. A structure according to claim 3 wherein said release means comprises a smooth walled tube fixed to the rear of the platform in surrounding spaced relation to the drive shaft, and an interiorally threaded diametrically split-nut portion fixed to the inner surface of that portion of the tube proximate to the lower end of the rear wall of the platform, a second interiorally threaded diametrically split-nut portion fixed to the inner surface of that portion of the upper end of the tube remote from the platform, and the threaded inner portions of said split-nut portions being spaced from the drive shaft when the drive shaft and the surrounding tube are axially aligned.

5. A structure according to claim 3 wherein said release means includes a split-nut connecting assembly.

6. A structure according to claim 5 wherein said split-nut connecting assembly includes a diametrically split-nut defining first and second split-nut portions, resilient means normally urging the first and second split-nut portions together and into threadable engagement with the drive shaft, and cam means operable to move the split-nut portions apart and disengage them from the drive shaft.

7. Apparatus according to claim 1 wherein said means to raise the platform comprises a shaft journaled within the cabinet and protruding therefrom for rotation on a horizontal axis, a toothed locking disc keyed on said shaft within the cabinet, a control knob projecting through the front wall of the cabinet and operatively connected to said coin operated release mechanism and to said locking disc, said coin release mechanism including means activating said control knob so the control knob can be manually pulled outwardly relative to the cabinet upon the insertion of appropriate coins in the cabinet, a lever having a free end and a locking end including a lug normally engageable with a tooth portion of the locking disc to prevent rotation of the disc, means operatively connecting said lever and said control knob and responsive to outward movement of the control knob relative to the cabinet to move the locking end of the lever out of engagement with the locking disc, a manually operable crank keyed to the shaft exteriorly of the cabinet and manually operable after movement of the locking lug from the locking disc to rotate said shaft and the locking disc, a vertically extending threaded rod medially located within said cabinet in supporting relation to said newspaper supply platform, drive means extending between said shaft and said threaded rod and responsive to manipulation of said crank to elevate the newspaper supply platform to newspaper dispensing position.

8. An apparatus according to claim 7 including safety means movable into locking engagement with the locking disc when the control knob is manually extended to actuate said lever and move the locking end of the lever and its lug out of engagement with the locking disc, means responsive to inward movement of the control knob to move said safety means out of locking engagement with the locking disc, and means for supporting the lever with its locking end and lug out of engagement with the locking disc while the crank is rotated to elevate the newspaper supply platform to newspaper dispensing rotation.

9. An apparatus according to claim 8 wherein the means in the path of travel of a dispensed newspaper for locking said means to raise the platform comprises a pivoted lever beneath the dispensing wedge and movable between an extended position in advance of a dispensed newspaper and a depressed position upon engagement by a dispensed newspaper, means connecting the pivoted lever to the locking end of the lever at said locking disc and responsive to elevation of the locking end of the lever out of engagement with the locking disc to move the pivoted lever to its extended position, and said means being responsive to depression of the pivoted lever by a dispensed newspaper to move the locking end of the lever and its lug into locking engagement with the locking disc to prevent the shaft on which the locking disc is keyed from being turned by the crank.

* * * * *